US009782019B2

(12) United States Patent
Narayanachar et al.

(10) Patent No.: US 9,782,019 B2
(45) Date of Patent: Oct. 10, 2017

(54) REFRIGERATED MERCHANDISER WITH PIVOTAL SHELF

(71) Applicant: Hussmann Corporation, St. Louis, MO (US)

(72) Inventors: Bhavya Narayanachar, Karnataka (IN); William E. Bries, St. Charles, MO (US); Michael L. Jones, St. Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 250 days.

(21) Appl. No.: 13/797,097

(22) Filed: Mar. 12, 2013

(65) Prior Publication Data

US 2014/0260394 A1 Sep. 18, 2014

(51) Int. Cl.

| | |
|---|---|
| ***A47F 3/04*** | (2006.01) |
| ***F25D 23/02*** | (2006.01) |
| ***A47F 3/06*** | (2006.01) |

(52) U.S. Cl.

CPC ..... *A47F 3/0426* (2013.01); *A47F 3/06* (2013.01); *F25D 23/02* (2013.01); *F25D 2325/021* (2013.01); *F25D 2325/023* (2013.01)

(58) Field of Classification Search

CPC ..... A47F 3/06; A47F 3/0426; A47F 3/0482; A47F 3/0469; A47F 5/0031; A47F 5/0037; A47F 5/13; A47B 96/025; F25D 2325/021; F25D 2325/023; F25D 25/027; F25D 25/02

See application file for complete search history.

(56) References Cited

U.S. PATENT DOCUMENTS

| | | | | |
|---|---|---|---|---|
| 1,925,371 A | * | 9/1933 | Charter | 211/153 |
| 1,997,432 A | * | 4/1935 | Replogle | 211/153 |
| 2,095,130 A | * | 10/1937 | Gates | F25D 25/02 160/222 |
| 2,319,470 A | | 5/1943 | Nobles | |
| 3,385,453 A | | 5/1968 | Dantino et al. | |
| 3,625,371 A | * | 12/1971 | Dill | 211/153 |
| 3,690,744 A | * | 9/1972 | Squire | 312/351 |
| 4,361,012 A | | 11/1982 | Ibrahim | |

(Continued)

FOREIGN PATENT DOCUMENTS

| | | |
|---|---|---|
| DE | 3613185 A1 | 10/1987 |
| EP | 1044639 | 6/2004 |

(Continued)

OTHER PUBLICATIONS

Patent Examination Report from the Australian Patent Office for Application No. 2013204124 dated Feb. 2, 2015 (5 pages).

*Primary Examiner* — Christopher R Zerphey
(74) *Attorney, Agent, or Firm* — Michael Best & Friedrich LLP

(57) ABSTRACT

A merchandiser that includes a case defining a product display area and a base defining a compartment below the product display area. The merchandiser includes a shelf coupled to the case within the product display area adjacent the base. The shelf is disposed over the compartment and includes a first portion and a second portion. Each of the first portion and the second portion define a product support area to support food product. Also, the second portion is pivotable relative to the first portion to provide access to the compartment.

22 Claims, 5 Drawing Sheets

(56) References Cited

U.S. PATENT DOCUMENTS

| | | | | |
|---|---|---|---|---|
| 4,369,632 | A | 1/1983 | Abraham | |
| 4,646,658 | A * | 3/1987 | Lee | 108/143 |
| 4,945,732 | A | 8/1990 | Haruyama et al. | |
| 4,964,281 | A | 10/1990 | Tanaka | |
| 5,347,827 | A * | 9/1994 | Rudick et al. | 62/440 |
| 5,450,971 | A * | 9/1995 | Boron | A47F 1/12 108/107 |
| 5,584,405 | A * | 12/1996 | Tunzi | 211/153 |
| 5,755,108 | A | 5/1998 | Ibrahim et al. | |
| 5,964,512 | A | 10/1999 | Borgen | |
| 6,272,876 | B1 * | 8/2001 | Roberts | A47F 3/0482 454/193 |
| 6,539,740 | B1 * | 4/2003 | Santana, Jr. | 62/255 |
| 6,755,042 | B2 | 6/2004 | Chuang et al. | |
| 6,973,800 | B2 | 12/2005 | Chuang et al. | |
| 7,010,924 | B2 | 3/2006 | Kempiak | |
| 7,681,409 | B2 | 3/2010 | Alahyari et al. | |
| 2002/0180323 | A1 | 12/2002 | Atalla et al. | |
| 2005/0030736 | A1 * | 2/2005 | Chuang | A47F 3/001 362/92 |
| 2011/0001415 | A1 * | 1/2011 | Park | F25D 25/02 312/408 |
| 2011/0163053 | A1 * | 7/2011 | Benneche et al. | 211/86.01 |

FOREIGN PATENT DOCUMENTS

| | | | |
|---|---|---|---|
| GB | 2153205 | A | 8/1985 |
| GB | 2221831 | A | 2/1990 |

* cited by examiner

REFRIGERATED MERCHANDISER WITH PIVOTAL SHELF

BACKGROUND

The present invention relates to merchandisers and, more particularly, to shelves for merchandisers.

Merchandisers generally include a case that defines a product display area for supporting and displaying food products. Refrigerated merchandisers often include a variety of internal features that are contained or housed by the case. The internal features may include, for example, components of the refrigeration system (e.g., fans, a thermo expansion valve, etc.), components that facilitate maintenance of the merchandiser (e.g., a drain) or electrical connections that allow a power source to power the merchandiser. It is often necessary to access the internal features to provide routine maintenance to the merchandiser or to fix unexpected problems that may arise. However, existing merchandisers are typically difficult to access because the entire bottom shelf needs to be removed. To move the shelf, all of the product on the shelf must also be moved.

SUMMARY

In one construction, the invention provides a merchandiser including a case that defines a product display area and that has a base defining a compartment below the product display area. The merchandiser also includes a shelf that is coupled to the case within the product display area adjacent the base. The shelf is disposed over the compartment and includes a first portion and a second portion. Each of the first portion and the second portion defines a product support area to support food product, and the second portion is pivotable relative to the first portion to provide access to the compartment.

In another construction, the invention provides a merchandiser including a case that defines a product display area and that has a base defining a compartment below the product display area. The merchandiser also includes a shelf that is coupled to the case within the product display area adjacent the base. The shelf is disposed over the compartment and includes a frame that has a first portion and a second portion movable relative to the first portion between a first position in which the first portion and the second portion cooperatively define a product support area to support food product, and a second position in which only the first portion defines a product support area to support food product and the second portion exposes an opening to provide access to the compartment.

In another construction, the invention provides a shelf for a merchandiser. The shelf includes a frame that has a first frame member, a second frame member opposite the first frame member, and a third frame member positioned between and spaced apart from the first frame member and the second frame member. The shelf also includes a first portion and a second portion. The first portion is coupled to the first frame member and to the third frame member, and defines a portion of a product support area of the shelf. The second portion is pivotably coupled to the third frame member and is movable relative to the second frame member. The second portion is also movable relative to the first portion between a first position defining another portion of the product support area and a second position in which only the first portion defines the product support area and second portion exposes an opening to provide access through the shelf.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
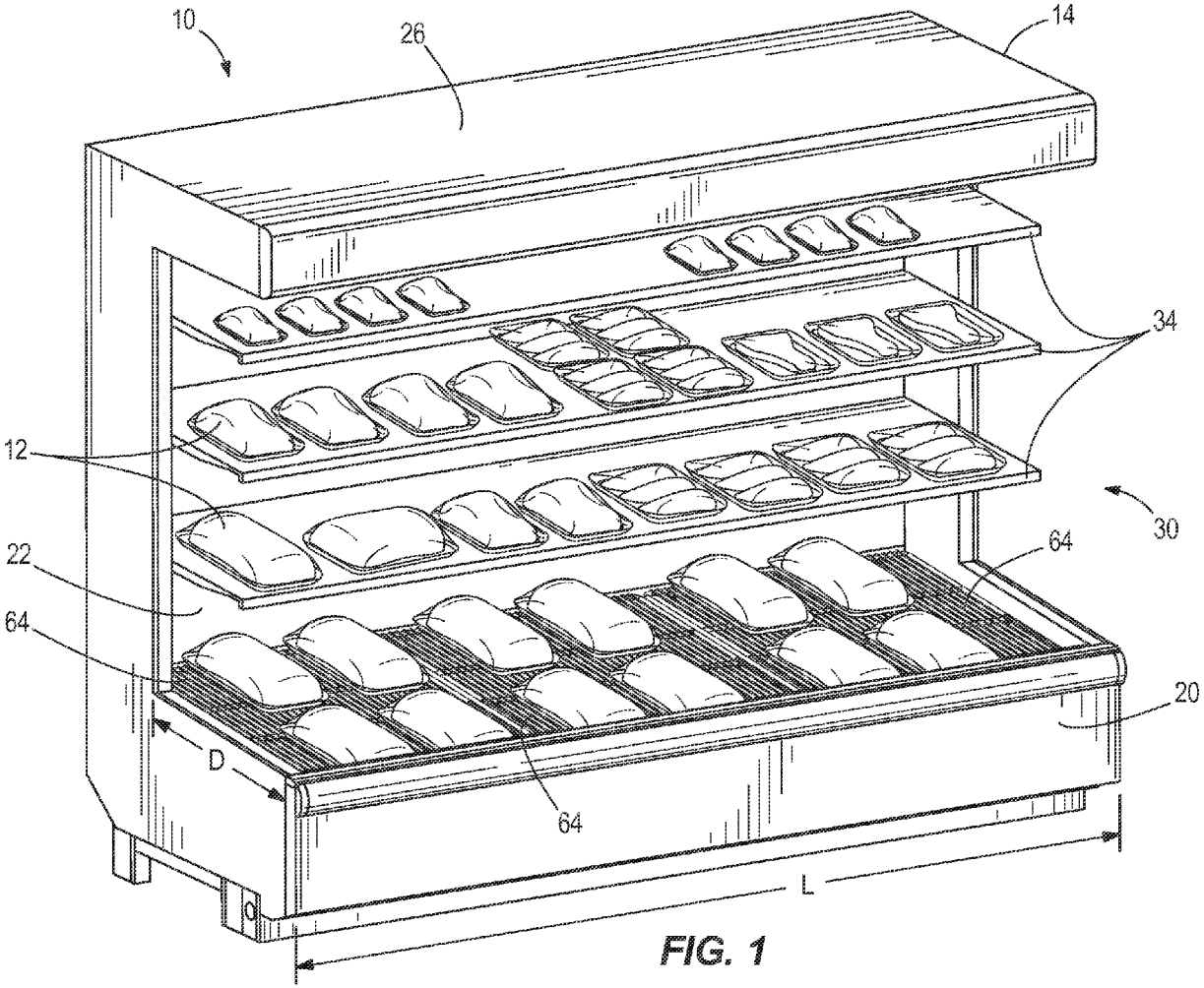
FIG. 1 is a perspective view of a merchandiser including a shelf according to one embodiment of the invention.

FIG. 1 shows one construction of a refrigerated merchandiser 10 that may be located in a supermarket or a convenience store (not shown) for presenting fresh food, beverages, and other food product 12 to consumers. The illustrated merchandiser 10 is an upright merchandiser that includes a case 14 that has a base 20, a rear wall 22, and a canopy 26. The base 20, the rear wall 22, and the canopy 26 cooperatively define a product display area 30 for supporting and displaying food product within the case 14. The refrigerated merchandiser 10 also includes a refrigeration system (not shown) in communication with the case 14 to condition or provide refrigerated airflow to the product display area 30. The food product 12 can be displayed on shelves 34 extending forwardly from a rear wall of the case 14 above the base 20.

Figure 5:
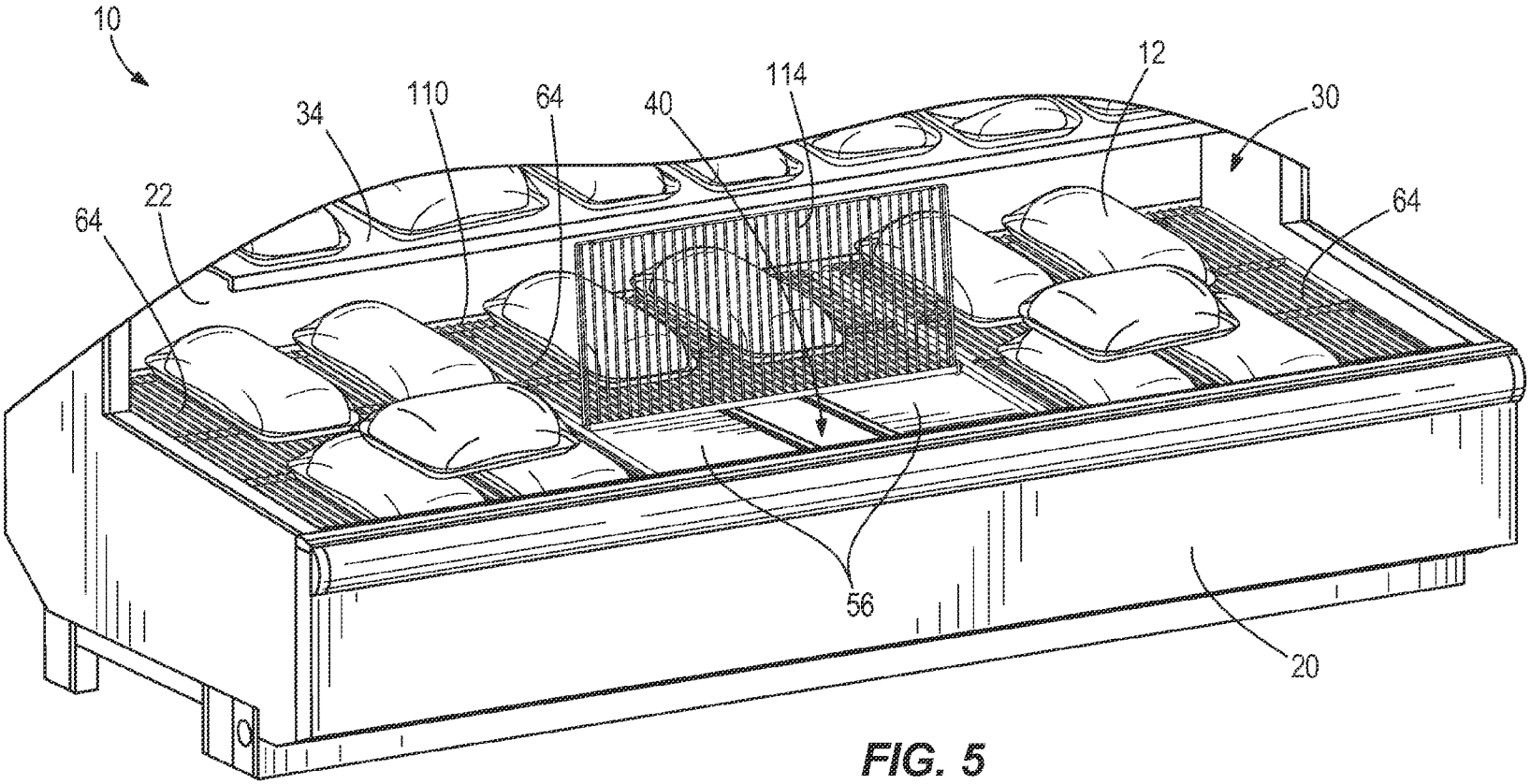
FIG. 5 is a perspective view of a bottom of the merchandiser of FIG. 1.
Figure 6:
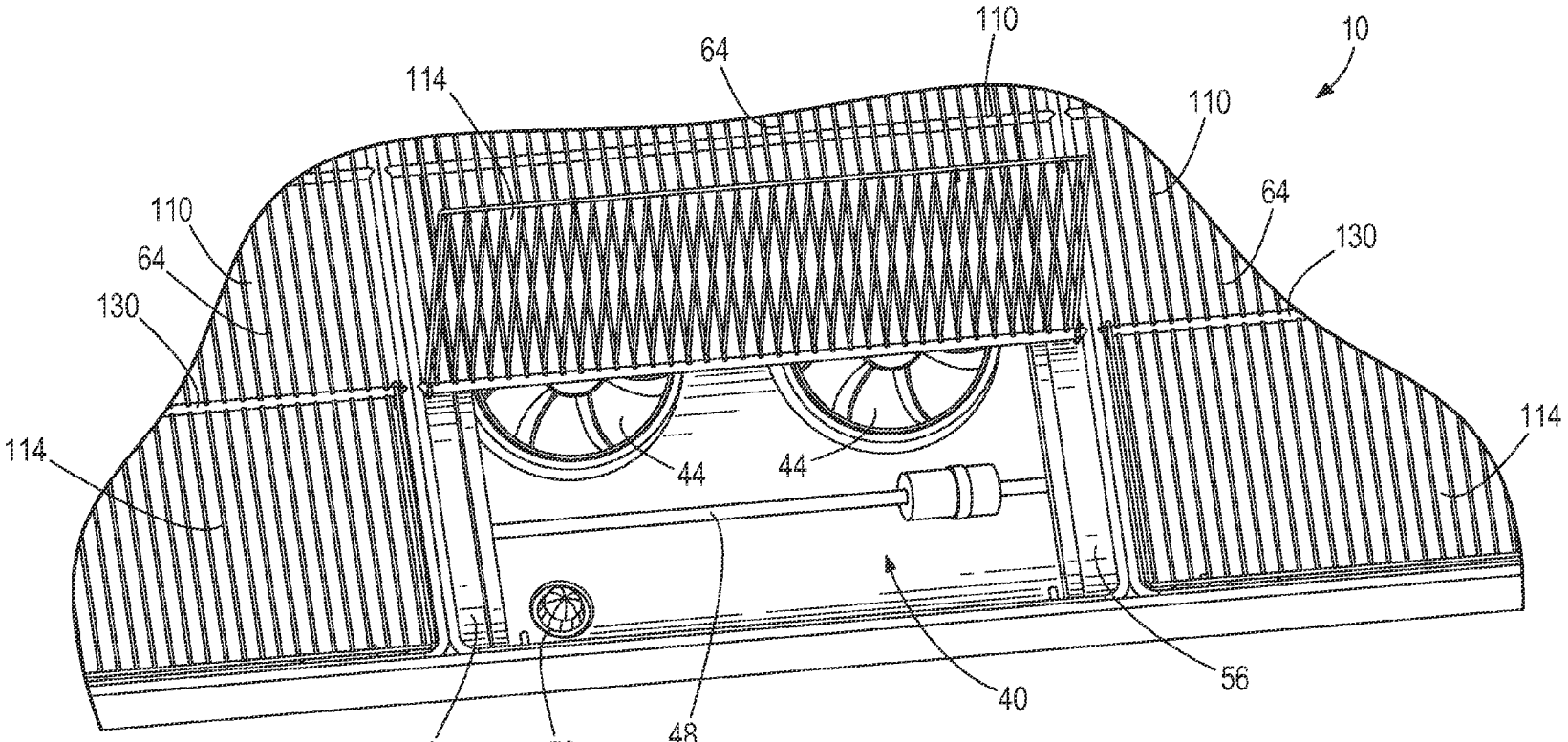
FIG. 6 is a top view of the bottom of the merchandiser of FIG. 5.

FIGS. 1, 5, and 6 show that the base 20 defines an interior or compartment 40 below the product display area 30. At least one refrigeration system component may be disposed in the compartment 40. For example, the compartment 40 may house, among other things, at least one fan 44, at least one expansion valve 48, and at least one drain 52. A cover 56 at least partially encloses the compartment 40 so that the compartment 40 is separated from the product display area 30 (e.g., to direct an airflow from the front of the case 14 to the rear wall 22). The cover 56 is slidable relative to the case 14 in order to expose the compartment 40. In the illustrated embodiment, the cover 56 includes a plurality of sections that are slidable relative to one another in order to provide access to the compartment 40.

With continued reference to FIGS. 1, 5, and 6, the merchandiser also includes shelves or racks 64 that are coupled to the case 14 within the product display area 30 adjacent the base 20 and positioned above or over the compartment 40 and the cover 56. The illustrated merchandiser 10 includes three shelves 64 disposed over the compartment 40, although fewer or more than three shelves 64 can be provided depending on the length L of the merchandiser 10.

The shelf 64 serves a dual purpose of displaying some food product 12 and providing access to the cover 56 and the compartment 40 without having to remove all of the food product 12 from the shelf 64, as described in detail below. The shelf 64 is coupled to a rear wall 22 of the case 14 and extends forward toward a front of the base 20. The shelf 64 can be oriented at any desired display angle within the case 14 (e.g., horizontal to approximately 50° relative to horizontal).

The shelf 64 includes a first portion 110 and a second portion 114 that are coupled to a frame 118. The second portion 114 is disposed adjacent the front of the base 20. The shelf 64 defines a product support area that supports food product 12 and that encompasses the area defined by the first portion 110 and the second portion 114. That is, each of the first portion 110 and the second portion 114 defines a portion of the overall product support area of the shelf 64.

Figure 2:
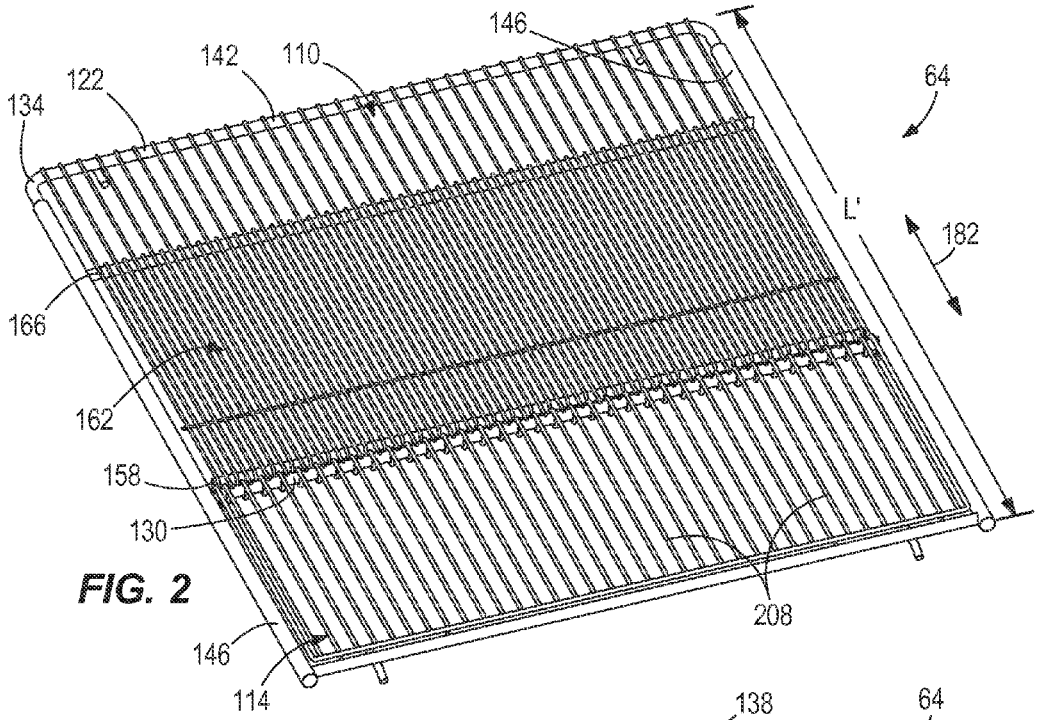
FIG. 2 is a prospective view of a section of a shelf in a first position.
Figure 3:
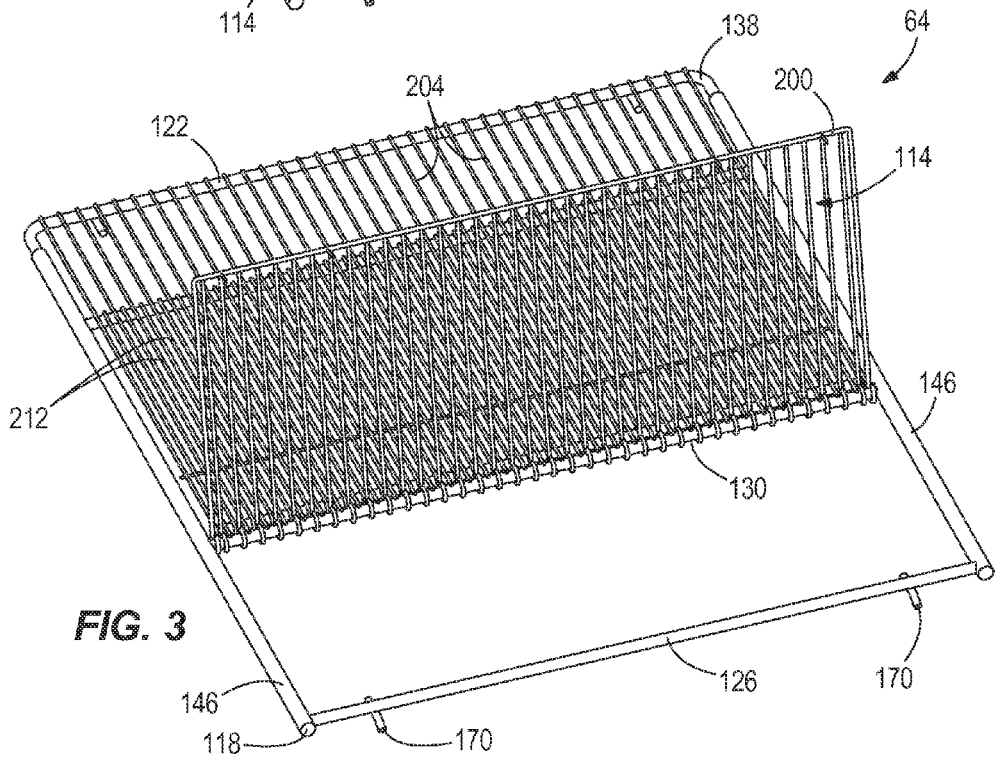
FIG. 3 is a perspective view of the section of the shelf of FIG. 2 in a second position.

With reference to FIGS. 1-3, the frame 118 includes a first or rear frame member 122 that is to the rear wall 22 at a desired height (to achieve the desired shelf viewing angle from outside the case 14) and a second or front frame member 126 that is secured to the front of the case 14. The illustrated frame 118 also includes a third frame member or pivot rod 130 that is positioned between and spaced apart from (and generally parallel to) the rear frame member 122 and the front frame member 126.

Figure 4:
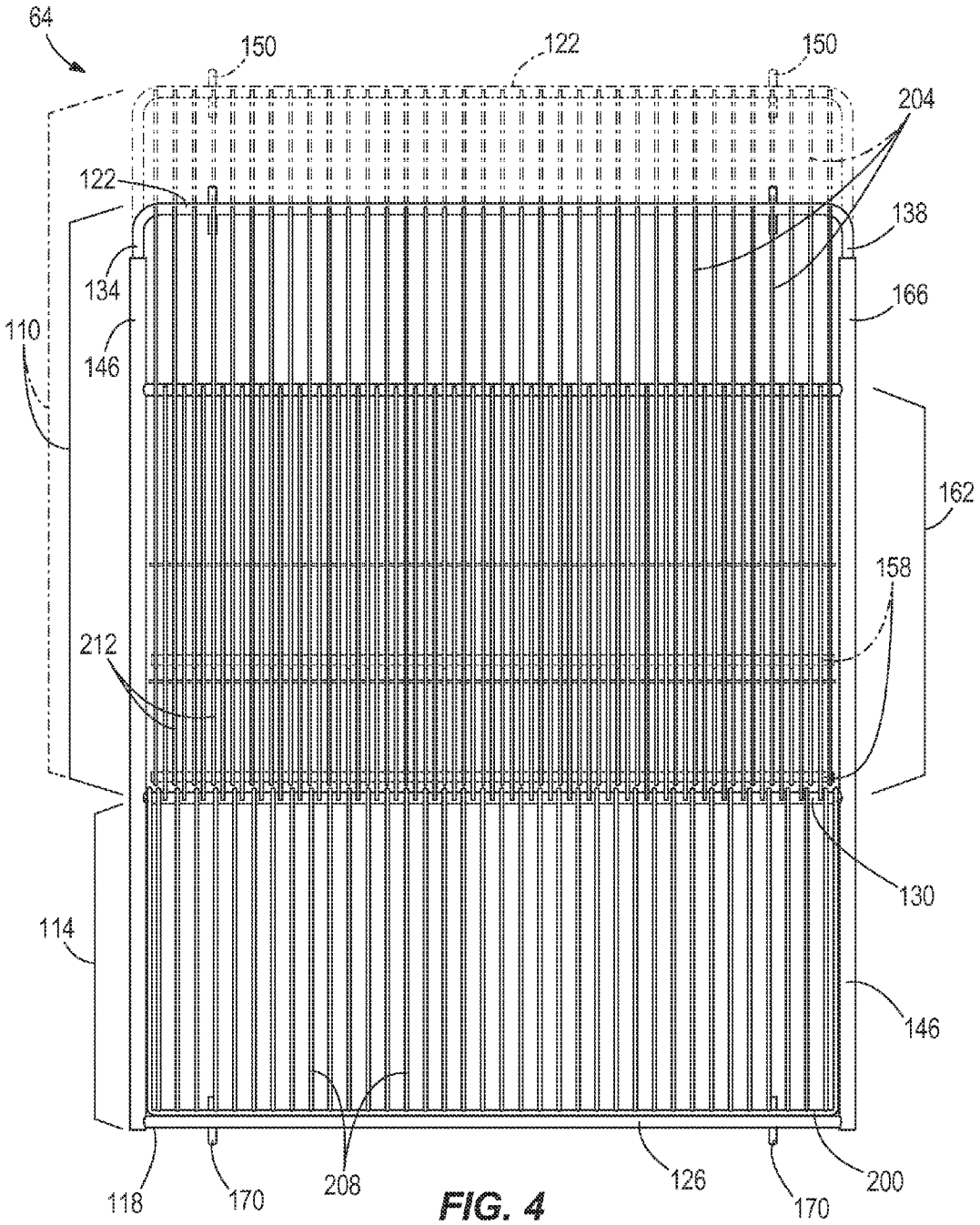
FIG. 4 is a top view of the bottom shelf.

FIGS. 2-4 show that the frame 118 is a telescopic frame that can be adjusted so that the product support area defined by the shelf 64 (e.g., the portion defined by the first portion 110 along the length L' of the shelf 64) can increase or decrease to accommodate merchandisers with different distances between the front of the case 14 and the rear wall 22 (defined by depth D in FIG. 1). As illustrated in FIG. 4, the rear frame member 122 is translatable relative to the pivot rod 130 to selectively increase or decrease the size of the product support area defined by the first portion 110, although the shelf 64 can be constructed so that one or both portions of the product support area defined by the respective first portion 110 and the second portion 114 can be adjusted. The rear frame member 122 has fourth frame members or telescoping rods 134, 138 that extend from opposite ends of a central rod 142 into peripheral frame members 146. The rods 134, 138 terminate inside the frame members 146. As illustrated, the pivot rod 130 is coupled to and extends between the peripheral frame members 146. The front frame member 126 is coupled to (e.g., welded) and extends between front ends of the peripheral frame members 146.

Referring to FIGS. 2-4, the frame 118 also includes a first intermediate member 158 that is disposed between but not directly coupled to the peripheral members 146. As described below, the first intermediate member 158 is slidable relative to the peripheral frame members 146 when the rear frame member 122 is telescopically extended and retracted relative to the frame members 146.

The rear frame member 122 can be secured at one of several heights along the rear wall 22 to achieve the desired viewing angle for the shelf 64. For example, the rear wall 22 of the merchandiser can include a plurality of notches (not shown) that are engageable by pins 150 coupled to the rear frame member 122. The front side of the shelf 64 can be engaged with the front inside area of the case 14 in a similar manner using pins 154. That is, the illustrated rear frame member 122 is indexable along the rear wall 22 of the merchandiser 10, and can be further indexable relative to the front of the case 14, if desired.

The frame 118 also has a stationary shelf portion 162 that partially defines the first portion 110. The shelf portion 162 is defined by the area between the pivot rod 130 and a second intermediate member 166 that extends between and is coupled to the peripheral members 146. As illustrated, the first portion 110 overlays the stationary frame portion 162 and is extensible rearward to expand the size of the product support area.

With reference to FIGS. 2-4, the first portion 110 is defined by the area of the shelf 64 between the rear frame member 122 and the pivot rod 130. Because the first portion 110 overlays the stationary frame portion 162, the first portion is translatable (in the directions indicated by arrow 182) relative to the stationary frame portion 162 to adjust the length (i.e. the size of the product support area) of the shelf 64. Stated another way, the stationary frame portion 162 acts as a bridge between the first portion 110 and the second portion 114 regardless of the length of the shelf 64.

The second portion 114 extends between the second frame member 126 and the pivot rod 130. The second portion is pivotable relative to the first portion about the pivot rod between a first position in which the second portion 114 defines a portion of the product support area, and a second, open position exposing an opening in the shelf 64 (see FIGS. 3 and 6). With reference to FIGS. 2-4, the second portion 114 extends between the pivot rod and a cantilevered shaft 200 that rests on the front frame member 126 when the second portion 114 is in the first, closed position. The second portion 114 is pivotable toward the second position to expose and provide access to the cover 56 and the compartment 40.

As illustrated, the first portion 110, second portion 114 and the stationary frame portion 162 are constructed of wireframe members 204, 208, 212, respectively. The wireframe 204 extends between the first frame member 122 and the first intermediate member 130. The wireframe 208 extends between the pivot rod 130 and the shaft 200. The wireframe 212 extends alongside a portion of the wireframe 204 between the pivot rod 130 and the second intermediate frame member 166. The first portion 110, 114, and the frame portion 162 can be formed of other material (e.g., plastic, composite, glass, fiberglass, etc.) that defines a solid or open support structure for food product 12.

The first portion 110 is translatable relative to the second portion 114 by extending or contracting the first frame member 122 relative to the frame members 146. When the first portion 110 is telescopically adjusted, the first intermediate frame member 158 moves with the remainder of the first portion 110 and relative to the pivot rod 130 and the wireframe 212 defining the frame portion 162. By pulling the first frame member 122 out of the frame members 146, the area defined by the first portion 110 is expanded or increased. Pushing the first frame member 122 into the frame members 146 shrinks or decreases the area defined by the first portion 110.

With reference to FIGS. 1, 2, and 4, when the second portion 114 is in the first position, the shaft 200 rests on the front frame member 126 so that the first and second portions 110, 114 cooperatively defined the largest possible product support area of the shelf 64. The cover 56 and the compartment 40 below the cover 56 are inaccessible when the second portion is in the first position.

With reference to FIGS. 3, 5, and 6, the second portion 114 can pivot to or toward the second position when it is desired to access the compartment 40. First, any food product 12 supported on the product support area defined by the second portion 114 is moved to another portion of the shelf 64 or another shelf 64 positioned adjacent the shelf 64. After the second portion 114 is cleared of food product, the front end of the second portion 114 (e.g., the shaft 200) can be lifted to expose the cover 56. The illustrated cover 56 can be slid left or right (e.g., over or under the adjacent cover 56) to expose the compartment 40. The second portion 114 can have a stop (not shown) that limits the open angle defined by the second portion 114 in the second position, or the second portion can be freely pivotable about the pivot rod 130 such that if no food product 12 is on the shelf 64, the second portion 114 can overlay the first portion 110 (e.g., the second portion 114 can pivot approximately 180° from the first position).

Components of the merchandiser 10 that are disposed in the interior of the compartment 40 can be accessed through the frame 118 when the second portion is in the second position. For example, one or more of the fans 44, the valve 48, and the drain 52 can be accessed without having to remove the entire shelf 64 or all of the food product 12 on the shelf 64. Only the first portion 110 defines the product support area when the second portion 114 is in the second position.

By incorporating a several shelves 64 into the merchandiser 10, access to components disposed in the compartment 40 (e.g., the fans 44, valves 48, and the drains 52) along the entire length of the merchandiser 10 can be accessed without having to remove a substantial amount of food product 12 from the shelves 64. That is, only a small amount of food product 12 supported on the shelves 64 has to be displaced and re-organized to perform routine maintenance or fix issues that may arise within the compartment 40.

Various features and advantages of the invention are set forth in the following claims.

The invention claimed is:

1. A merchandiser comprising:

a case defining a product display area configured to present food product, the case including a base including a front face and defining a compartment below the product display area;

a drain positioned in the compartment;

a refrigeration system in communication with the case to condition the product display area, the refrigeration system including at least one refrigeration system component disposed in the compartment; and a shelf defining a plane and coupled to the case within the product display area adjacent the base, the shelf disposed over an area of the compartment and including a first portion and a second portion, each of the first portion and the second portion defining a product support area configured to support and contact food product, wherein the second portion is pivotable relative to the first portion between a first position configured to support and contact food product and a second position in which food product is removed from the second portion and an opening is exposed through the shelf and configured to provide access to the area of the compartment below the shelf and to expose one or both of the drain and the at least one refrigeration system component when the second portion is in the second position, wherein the area of the compartment below the shelf is inaccessible from adjacent the product display area when the second portion is in the first position, and wherein the front face of the base extends at least to the plane of the shelf.

2. The merchandiser of claim 1, wherein the shelf includes a telescopic frame and the first portion and the second portion are coupled to the frame.

3. The merchandiser of claim 1, further comprising a cover coupled to the base to at least partially enclose the compartment, and wherein the shelf is positioned above the cover.

4. The merchandiser of claim 3, wherein the cover is slidable relative to the case to expose the compartment.

5. The merchandiser of claim 1, wherein the case defines an upright merchandiser and the shelf is coupled to a rear wall of the case and extends forward toward a front of the base, and wherein the second portion is disposed adjacent the front of the base.

6. The merchandiser of claim 1, wherein the shelf includes a frame having frame members and a pivot rod extending across the frame interior of the frame members, and wherein the first portion extends between one of the frame members and the pivot rod, and the second portion extends between another of the frame members opposite the one of the frame members and the pivot rod.

7. A merchandiser comprising:

a case defining a product display area configured to present food product, the case including a base including a front face and defining a compartment below the product display area;

a drain positioned in the compartment;

a refrigeration system in communication with the case to condition the product display area, the refrigeration system including at least one refrigeration system component disposed in the compartment; and a shelf defining a plane and coupled to the case within the product display area adjacent the base, the shelf disposed over an area of the compartment and including a frame having a first portion and a second portion pivotable relative to the first portion between a first position in which the first portion and the second portion cooperatively define a product support area configured to support and contact food product and a second position in which only the first portion defines a product support area configured to support and contact food product and the second portion exposes an opening through the frame to provide access to the area of the compartment below the shelf and one or both of the drain and the at least one refrigeration system component, wherein the area of the compartment below the shelf is inaccessible from adjacent the product display area when the second portion is in the first position, and wherein the front face of the base extends at least to the plane of the shelf.

8. The merchandiser of claim 7, wherein the first portion is movable relative to the second portion to selectively increase or decrease a size of the product support area.

9. The merchandiser of claim 7, further comprising a cover coupled to the base to at least partially enclose the compartment, and wherein the shelf is positioned above the cover.

10. The merchandiser of claim 9, wherein the cover is slidable relative to the case to expose the compartment.

11. The merchandiser of claim 7, wherein the case defines an upright merchandiser and the shelf is coupled to a rear wall of the case and extends forward toward a front of the base, and wherein the second portion is disposed adjacent the front of the base.

12. The merchandiser of claim 7, wherein the second portion is pivotable to expose one or both of the drain and the at least one refrigeration system component.

13. The merchandiser of claim 7, wherein the frame has frame members and a pivot rod extending across the frame interior of the frame members, and wherein the first portion extends between one of the frame members and the pivot rod, and the second portion extends between another of the frame members opposite the one of the frame members and the pivot rod.

14. A shelf for a merchandiser, the shelf comprising:

a frame defining a plane of the shelf and including a first frame member and a second frame member opposite the first frame member, the frame further including a third frame member positioned between and spaced apart from the first frame member and the second frame member, each of the first frame member and the second frame member extending parallel to the third frame member;

a first portion coupled to the first frame member and to the third frame member, the first portion defining a portion of a product support area of the shelf configured to contact and support food product;

a second portion pivotably coupled to the third frame member and movable relative to the second frame member, the second portion movable relative to the first portion about a longitudinal axis extending along the length of the third frame member between a first position defining another portion of the product support area configured to contact and support food product and a second position in which only the first portion defines the product support area and the second portion exposes an opening to provide access through the shelf, wherein the opening is partially defined by the second frame member and the third frame member, wherein, in the first position and the second position of the second portion, the first frame member defines a first longitudinal edge of the shelf and the second frame member defines a second longitudinal edge of the shelf, wherein the first and second longitudinal edges lie in the plane in the first position and the second position, wherein the first frame member is translatable relative to the third frame member to selectively increase or decrease a size of the product support area, and wherein the opening provides access through the shelf to an area of the merchandiser below the shelf and one or both of a drain and at least one refrigeration system component.

15. The shelf of claim 14, wherein the frame further includes fourth frame members coupled to and extending between ends of the first frame member and ends of the third frame member, and wherein the first frame member is telescopically engaged with the fourth frame members.

16. The shelf of claim 14, wherein the first portion is defined by the area between the first frame member and the third frame member.

17. The shelf of claim 16, wherein the second portion has a first end pivotably engaged with the third frame member and a second end disposed adjacent the second frame member.

18. The shelf of claim 17, wherein each of the first portion and the second portion is defined by a wireframe.

19. The shelf of claim 14, wherein the first, second, and third frame members cooperatively define a portion of a perimeter of the shelf.

20. The shelf of claim 14, wherein the first frame member is translatable relative to the third frame member in the plane of the shelf.

21. The shelf of claim 14, wherein the first frame member is translatable relative to the second frame member to selectively increase or decrease the size of the product support area.

22. The shelf of claim 14, wherein the first frame member is configured to translate without moving the third frame member.

* * * * *